US006809753B2

(12) United States Patent
Tu

(10) Patent No.: US 6,809,753 B2
(45) Date of Patent: Oct. 26, 2004

(54) OPTICAL MICROSWITCH PRINTER HEADS

(76) Inventor: Xiang Zheng Tu, 1293 Westwood St., Redwood City, CA (US) 94061

( * ) Notice: Subject to any disclaimer, the term of this patent is extended or adjusted under 35 U.S.C. 154(b) by 31 days.

(21) Appl. No.: 10/281,452

(22) Filed: Oct. 25, 2002

(65) Prior Publication Data

US 2004/0081498 A1 Apr. 29, 2004

(51) Int. Cl.[7] ..... B41J 2/465
(52) U.S. Cl. ..... 347/239; 347/255
(58) Field of Search ..... 347/239, 255; 359/237–324

(56) References Cited

U.S. PATENT DOCUMENTS 5,739,945 A * 4/1998 Tayebati ..... 359/291
6,597,490 B2 * 7/2003 Tayebati ..... 359/291
2003/0112517 A1 * 6/2003 Corzine et al. ..... 359/584

* cited by examiner

*Primary Examiner*—Huan Tran
(74) *Attorney, Agent, or Firm*—Bruce H. Johnsonbaugh

(57) ABSTRACT

An optical microswitch printer head comprising a micromachined optical microswitch array with optical microswitches extending in a main scanning direction. The optical microswitch is based on a variable air gap Fabry-Perot cavity that is defined by two non-absorbing distributed Bragg reflectors. One of the distributed Bragg reflectors is supported by flexible beams so that the length of the Fabry-Perot cavities can be set to be equal to an odd or even multiple of a quarter wavelength of a working optical wave by applying a voltage. As a result, the optical microswitches can be pushed into a transmission state or "on" state for letting a light pass through or a reflection state or "off" state for blocking the light. The optical microswitch printer head can utilize a gas discharge lamp such as a cold cathode fluorescent lamp as a light source. The light irradiated from the gas discharge lamp shines over all the optical microswitches, but the optical microswitches are selectively switched "on" or "off" so as to generate light signals for graphic image formation Since the fabrication process of the optical microswitch array is based on standard IC technology, it can be batch-produced at lower cost.

25 Claims, 8 Drawing Sheets

OPTICAL MICROSWITCH PRINTER HEADS

FIELD OF THE INVENTION

This invention generally relates to optical printer heads, and particularly relates to micromachined optical microswitch printer heads which shine a lamp light through a plurality of addressable optical microswitches that let the light pass or block the light so as to generate light signals for graphic image formation.

BACKGROUND OF THE INVENTION

Laser printers become popular due to a number of advantages over the rival inkjet technology. They produce much better quality black text documents than inkjets, and they tend to be designed more for the long haul—that is, they turn out more pages per month at a lower cost per page than inkjets. So, if it is an office workhorse that is required, the laser printer may be the best option. Another factor of importance to both the home and business user is the handling of envelopes, card and other non-regular media, where lasers once again have the edge over inkjets.

However, a laser source consists of a large relatively heavy, but delicate arrangement built into a large case. The case contains a single laser light source and a complex system of lenses and rotating mirrors that deflect the laser beam across the drum as it rotates. Complex timing is used to ensure that the laser can still produce a horizontal track across the drum surface while the drum continuously rotates. The edges of the drum are further from the laser than the center and so careful parallax correction must be employed. There is a limit to how fast the drum can be rotated while maintaining the horizontal scanning integrity.

LED (light-emitting diode) page printing is touted as the next big thing in laser printing. This technology produces the same results as conventional laser printing and uses the same fundamental method of applying toner to the paper The difference between the two technologies lies in the method of light distribution. The LED printer functions by means of an array of LEDs that create an image when shining down at 90 degrees. The advantage is that a row of LEDs is cheaper to make than a laser and mirror with lots of moving parts and, consequently, the technology presents a cheaper alternative to conventional laser printers. The LED system also has the benefit of being compact in relation to conventional lasers. Color devices have four rows of LEDs—one each for cyan, magenta, yellow and black toners—allowing color print speeds the same as those for monochrome units.

The principal disadvantage of LED technology is that the quality of light from each element is dispersive and beam spot shapes are not uniform. The dispersed quality of light and the lack of uniformity of the beam spot shapes generate an uneven dot density of an output image such as an image containing black stripes. Moreover, an LED printer's drum performs at its best in terms of efficiency and speed when continuous, high-volume printing is called for. In much the same way as a light bulb's lifetime is shortened the more it is switched on and off, so an LED printer's drum lifetime is shortened when used often for small print runs.

SUMMARY OF THE INVENTION

Along with developments in office automation products, the optical printers with improved performance are in strong demand.

It is therefore a general object of the present invention to provide an optical microswitch printer head that reduces the cost of printing pages and also to reduce the cost of making the printer.

A particular object of the present invention is to provide an optical microswitch printer head that enables the use of various light sources instead of only lasers and LEDs so as to extend usable optical spectrum range.

Another particular object of the present invention is to provide an optical microswitch printer head that enables the use of a high energy efficient light source instead of low energy efficient lasers and LEDs so as to reduce power consumption.

Still another particular object of the present invention is to provide an optical microswitch printer head that enables the use of a cheap light source instead of expensive lasers and LEDs so as to reduce production cost.

Still another particular object of the present invention is to provide an optical microswitch printer head that does not need to switch the light source for generating a light signal so as to increase the lifetime of the light source.

Still another object of the present invention is to provide an optical microswitch printer head in which formation of a pixel is accomplished through a micromachined optical switch so as to improve the resolution of the image.

Still another particular object of the present invention is to provide an optical microswitch printer head in which a needed driver circuit is integrated with the optical microswitches on a single substrate so as to simplify the control system and further reduce the production cost.

According to the features of the present invention, there is provided an optical microswitch printer head comprising an optical microswitch array with optical microswitches extending in a main scanning direction. The optical microswitch is based on a variable air gap Fabry-Perot cavity that is defined by two non-absorbing distributed Bragg reflectors. Since one of the distributed Bragg reflectors is supported by flexible beams, the length of the individual Fabry-Perot cavities can be set to be an odd or even multiple of a quarter wavelength of a working optical wave by applying a voltage. As a result, the optical microswitches can be pushed into a transmission state or "on" state for letting a light passing through or a reflection state or "off" state for blocking the light.

In order to operate the optical microswitches the optical microswitch printer head includes a driver circuit. The driver circuit can be integrated in a single substrate with the optical microswitches or bonded onto a substrate that carries the optical microswitches.

The optical microswitch printer head can utilize a conventional gas discharge lamp as a light source. The light irradiated from the conventional gas discharge lamp shines over all the optical microswitches, but the optical microswitches are selectively switched "on" and "off" so as to generate light signals for graphic image formation.

The variable air gap Fabry-Perot cavity can be fabricated by surface micromachining technology. Surface micromachining adapts planar fabrication process steps known to the integrated circuit (IC) industry to manufacture micro-electro-mechanical or micro-mechanical system (MEMS) devices. The standard building-block processes for surface micromachining are deposition and photolithographic patterning of alternate layers of low-stress functional material such as a silicon nitride ($Si_3N_4$), amorphous silicon carbide (SiC) and polycrystalline silicon (also referred to a polysilicon) and a sacrificial material such as silicon dioxide ($SiO_2$) or phosphorosilicate glass (PSG).

It is well-known that a low-stress functional material can be deposited by a low temperature process such as plasma enhanced deposition (PECVD). However, the etch selectivity of a conventional $SiO_2$ sacrificial layer over a PECVD silicon nitride layer in hydrofluoric acid (HF) solution is very low. To solve this problem, an electrode material is inserted between the PECVD deposited silicon nitride layer and the $SiO_2$ sacrificial layer. Such an electrode material comprises Indium Tin Oxide ($In_2O_3$:$SnO_2$) or the like that does not be attacked by HF solution.

Surface micromachining results in a suspended mechanical structure generally consisting of a central plane and at least two side flexible beams. The two side flexible beams support the central plane and the central plane carries a distributed Bragg reflector thereon. Such a suspended mechanical structure can be moved with high precision with an applied voltage so as to change the length of the air gap between the two distributed Bragg reflectors. Since the entire process is based on standard IC fabrication technology, compact, highly, functional, and more self-contained micro-optic printer heads can be batch-fabricated.

The distributed Bragg reflectors comprise a stack of alternation layers of low refractive index material and high refractive index material. Such high refractive index materials include titanium dioxide ($TiO_2$) with refractive index 2.34 and tantalum pentoxide$_2$($Ta_5O$) with refractive index 2.16 at wavelength 400 nm. Such a low refractive index material includes $SiO_2$ with refractive index 1.47 at wavelength 400 nm. The thickness of each layer is equal to $\lambda_0/4n$, where $\lambda_0$ is the light wavelength of the working light wave and n is the refractive index. A high quality distributed Bragg reflector is required to have high reflectivity and low absorption. It has been reported that at 1.55 $\mu$m wavelength the reflectivity and stop band of a 5.5-period $TiO_2/SiO_2$ quarter-wavelength distributed Bragg reflector are 98.7% and 252 nm, respectively. A $TiO_2/SiO_2$ multilayered structure can be an alternative of the distributed Bragg reflectors. In addition, the refractive index of a $SiN_x$ layer can be adjusted up to 2.15 by an improved PECVD technology. Using such PECVD deposited $SiN_x$, a 10 periods $SiN_x/SiO_2$ distributed Bragg reflector can have a stop band larger than 200 nm and a reflectivity higher than 99.7%.

In order to properly vary the length of the air gap of a Fabry-Perot cavity, the driver circuit is implemented such that the "on" and "off" states of the variable air gap Fabry-Peroy cavities are set by two separate variable voltage sources. When one or more optical microswitches are switched to an "on" state by applying one voltage source, the rest of the optical microswitches are switched to "off" state by applying the other voltage source. When a change in the working light wavelength takes place, the corresponding "on" and "off" voltage values also are changed.

DETAILED DESCRIPTION OF THE INVENTION

Figure 1:
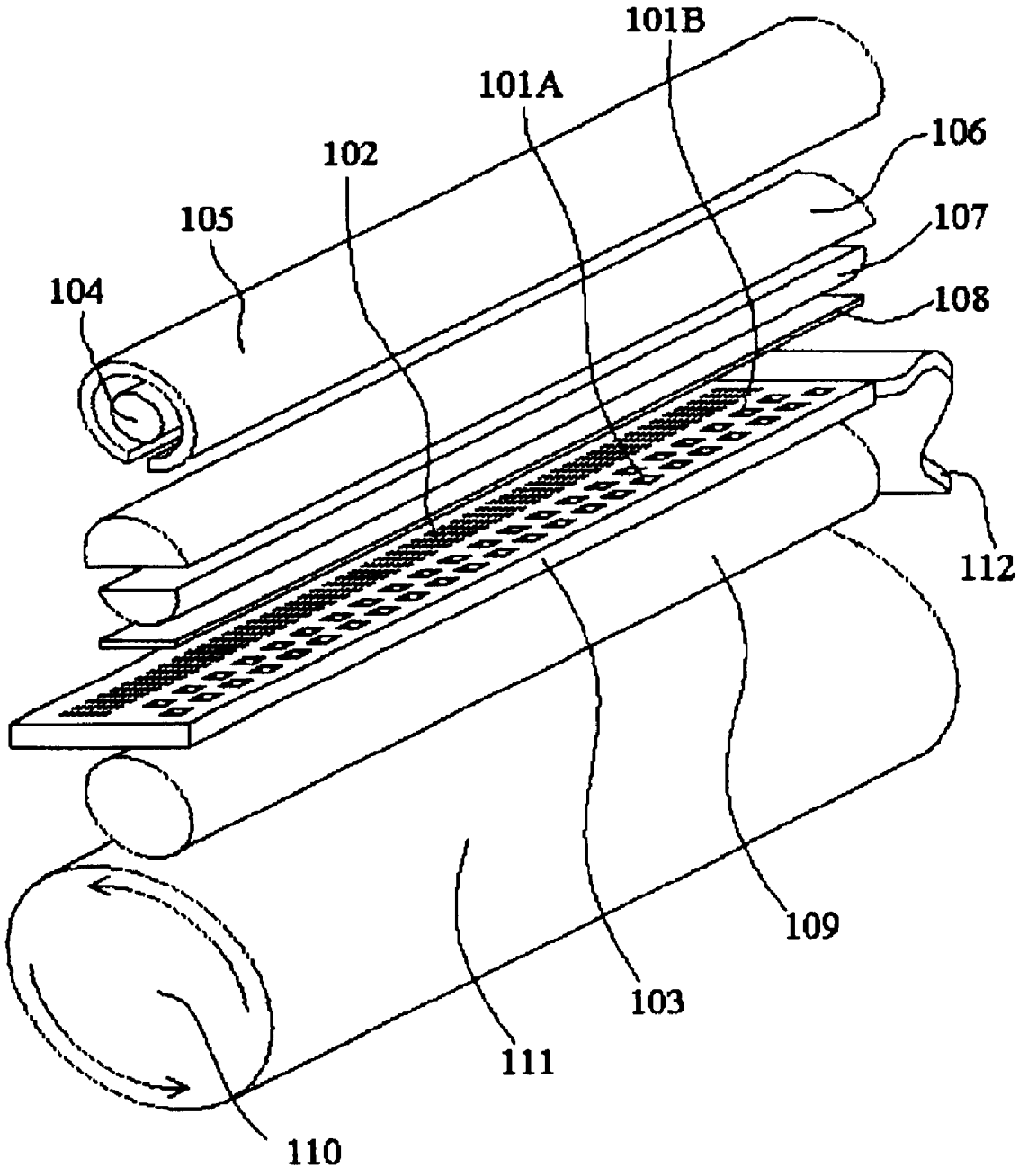
FIG. 1 is a simplified perspective view of an optical microswitch printer head in accordance with the present invention.

According to the present invention, an optical microswitch printer head, as shown in FIG. 1, comprises a substrate 103, an optical microswitch array including a row 101A and a row 101B; a driver circuit 102; a light source 104; a reflector 105; a collimator consisting of two half-cylindrical lenses 106 and 107; a filter 108; a light-sensitive material 111 covering the peripheral surface of a drum 110; a cylindrical lens 109; and an adapter 112.

The optical microswitches including a row 101A and a row 101B which extend in a main scanning direction of the printer head. Each of the optical microswitches comprises a variable air gap Fabry-Perot cavity that is defined by two non-absorbing distributed Bragg reflectors. Such a distributed Bragg reflector consists of alternating layers of a low refractive index dielectric material and a high refractive index material. All these dielectric materials are preferable to be transparent in the visible light regime. The refractive index ratio of the two dielectric materials is preferable to be high enough so as to obtain a distributed Bragg reflector with a high reflectivity and a high reflection stopband with a small number of pairs of the two different dielectric material layers. One of the distributed Bragg reflectors of the optical microswitches is carried by a flexible structure that may consist of a central plane and at least two beams disposed on the edge of the central plane. Furthermore a pair of electrodes is attached to the cavity so as to vary the length of the air gap of the cavity by applying a voltage. The driver circuit 102 is integrated in a single substrate with the optical microswitches through monolithic integration or hybrid packaging. The proximal end of the adapter 112 is attached to the substrate 103. The distal end of the adapter 112 is connected to a printer's CPU. The CPU provides an electronic signal to the driver circuit 102. The driver circuit 102 turns the optical microswitches "on" and "off" according to the input electronic signal. And then the electronic signal is further converted into a light signal through the optical microswitches.

The light source 104 irradiates light that passes through a plurality of selectively switched-on optical microswitches for generating light signals. It should be noted that the optical microswitch printer head is able to utilize conventional and cheap lamps as a light source instead of semiconductor lasers or LEDs as a light source. A preferable light source comprises gas discharge lamps such as cold cathode fluorescent lamps.

The cold cathode fluorescent lamps are low-pressure gas discharge lamps that are very energy efficient (up to 100 lumens per watt). With fluorescent lamps, the amount and color of light emitted depends on the type of phosphor coating applied to the inside of the lamp. The wide range of phosphors available makes it possible to produce many different color tones (color temperatures) and different levels of color quality.

The reflector 105 is used to condense the light irradiated from the gas discharge lamp 104 so as to propagate out from a slot that is parallel to the main scanning direction. The collimator consists of two half-cylindrical lenses 106 and 107 that condense the light propagating out of the slot so as to be projected onto the optical microswitches perpendicularly. The filter 108 only allows the light with a selected wavelength to illuminate the optical microswitches.

It should be noted that the light source might be an integrated parabolic or ellipsoidal high intensity radiation source that provides a collimated light beam. Such devices are available from a variety of vendors In such implementations, the light source may thus include, or be coupled to, one or more lenses, mirrors, and/or other optical elements constructed and arranged to direct, focus, and/or collimate the light.

The light-sensitive material 111 covers the peripheral surface of a drum 110 that can be rotated around an axis parallel to the main scanning direction. The cylindrical lens 109 is configured such that the light signals generated by the optical microswitches are condensed onto the light-sensitive material 111 to form a latent image. The adapter 112 is attached to the substrate 103 containing the optical microswitch array including a row 101A and a row 101B and driver circuit 102 thereon and connecting the driver circuit 102 to a printer's CPU that controls the driver circuit 102.

As can be seen in FIG. 1, the optical switch array includes a first optical switch row 101A and a second optical switch row 101B both of which are positioned parallel to each other. Each optical switch row will form an image on an individual line if the optical switches of the two rows are switched "on" at a same time. Therefore, as soon as the two optical switch rows are switched "on" apart at a predetermined time and the drum is rotated at a predetermined speed it is possible to make the latent image formed on the light-sensitive material surface on a single line.

The optical switch array is not restricted to two rows, but can include a third row or even include four or more rows. In these cases, each optical switch row is shifted (P/number of optical switch row) pitch with respect to the others, in the main scanning direction, where P is a pitch of optical switches. Therefore, the optical switches on the optical switch rows are displaced (P/number of LED arrays) pitch with respect to each other.

By forming the optical switch printer head in this manner, using optical switch rows of a single type with the same pixel densities, it is possible to obtain graphical images with resolutions multiplied by the number of optical switch rows used.

Figure 2A:
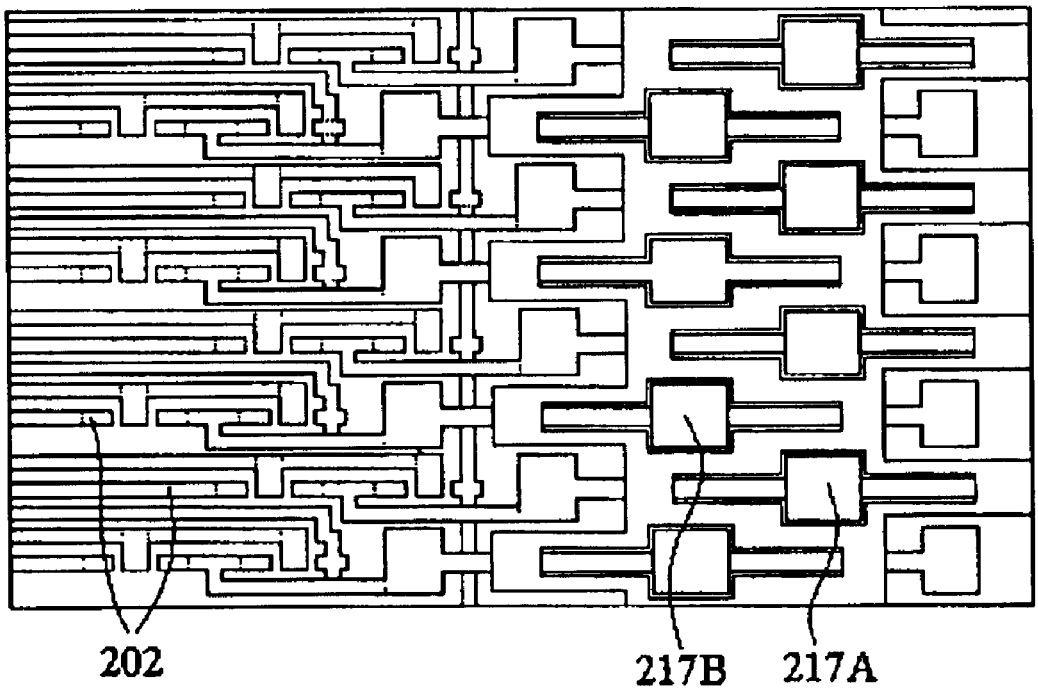
FIGS. 2(A) and (B) are top plane and cross-sectional views of an optical microswitch array in accordance with the first embodiment of the present invention.
Figure 2B:
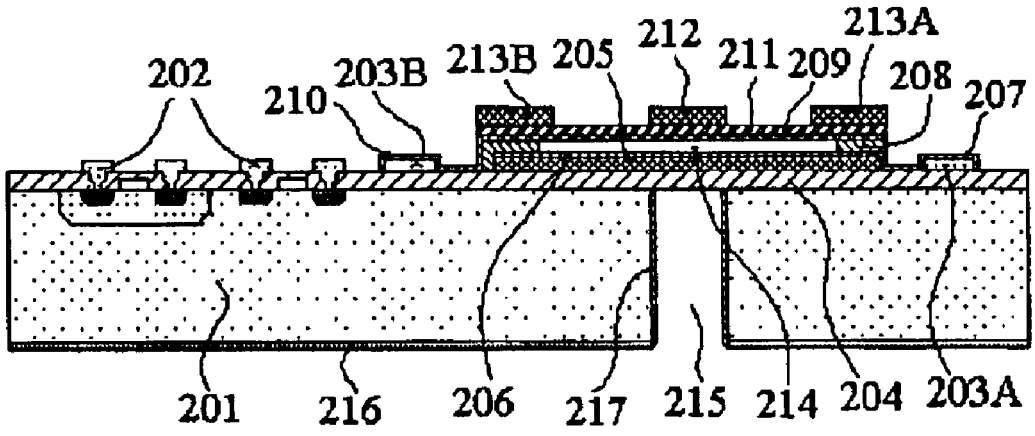

As shown in FIGS. 2(A) and 2(B), a first embodiment of an optical microswitch array, in accordance with the present invention, comprises a plurality of optical microswitches including a row 217A and a row 217B and a CMOS driver circuit 202 which are integrated together by monolithic integration or hybrid packaging (not shown in FIGS. 2(A) and 2(B).

Each of the optical microswitches consists of a bottom supporting layer 204; a bottom distributed Bragg reflector 205; a bottom electrode 206; a top electrode 209, a top supporting structure 211; a top distributed Bragg reflector 212; a middle air gap 214; and a separating layer 208.

The bottom-supporting layer 204 is a transparent dielectric material layer comprises $SiO_2$ or $Si_3N_4$. Preferably the bottom-supporting layer comprises phosphousilicate glass that can be used as a passivation layer of the CMOS driver circuit 202. The distributed Bragg reflectors 205 and 212 comprise a stack layer of alternating layers of non-absorbing high refractive index dielectric material and low refractive index dielectric material. Such a stack layer includes alternating layers of $SiO_2$ and $TiO_2$ or $SiO_2$ and $Ta_2O_5$, or $SiO_2$ and $SiN_x$. These alternating layers have a thickness equal to $\lambda_0/4n$, where $A_0$ is the working optical wavelength and n is the refractive index.

The bottom electrode 206 has an extended portion 207 covering a connection pad 203A that is formed during the process of forming the CMOS driver circuit 202. The top electrode 209 has an extended portion 210 covering another connection pad 203B. The electrodes 206 and 209 comprise $In_2O_3$ $SnO_2$(5–10%) or the like. Such an alloy is transparent in the visible light regime.

The air gap 214 is sandwiched in by the bottom electrode 206 and top electrode 209 and surrounded by the separating layer 208. A portion of the separating layer 208, which is sandwiched in between the two electrodes 206 and 209, has been selectively etched so as to form the air gap 214. Because of this, the separating layer 208 can be named a sacrificial layer.

The top supporting structure 211 may consist of a central plane and at least two beams disposed on the edge of the central plane. One end of a beam is connected to the central plane and the other end is anchored on the edge of the separating layer 208. When a voltage is applied to the electrodes 206 and 209, an electrostatic force is generated across the cavity and the two beams can be bent so as to vary the length of the air gap. When the length of the air gap reaches odd multiple of $\lambda/4$ the reflectivity of the cavity becomes maximum. When the length of the air gap reaches an even multiple of $\lambda/4$, the transmission of the cavity becomes maximum. Based on this physical phenomenon, the cavity can work as an optical switch by setting the cavity at a transmission state or "on" state or a reflection state or "off" state.

The top supporting structure 211 may comprise $Si_3N_4$ or amorphous SiC that are transparent in visible light regime. $Si_3N_4$ and amorphous SiC can be formed by PECVD. The top supporting structure may also comprise polysilicon Polysilicon is not transparent in the visible light regime, but for a very thin polysilicon layer the light loss due to the absorption is very small. Polysilicon can be formed by two-step process. The first step is to form amorphous silicon by PECVD. The second step is to convert amorphous silicon into polysilicon by low temperature recrystallization.

As can be seen in FIGS. 2(A) and 2(B), each variable air Fabry-Perot cavity is connected to the driver circuit through electrical interconnection that is formed on the silicon substrate. Furthermore, the optical microswitch array includes two optical microswitch rows 217A and 217B set apart by a certain distance, each row having a certain number of optical microswitches arranged at a certain pitch. Actually, the optical microswitch array may have more optical microswitch rows, if it is needed.

The optical microswitch array further comprises a plurality of light guiding holes 215 that are disposed in the silicon substrate 201 and each perpendicularly extends to a corresponding variable air gap Fabry-Perot cavity situated above the light guiding hole. The sidewalls of the through holes 215 may be coated with a metal reflecting layer 217. The backside of the silicon substrate 201 may also be coated with a reflecting layer 216. It should be noted that the optical microswitch array still further comprises an adapter (not shown in the figure) for interfacing to a printer's CPU.

Figure 3A:
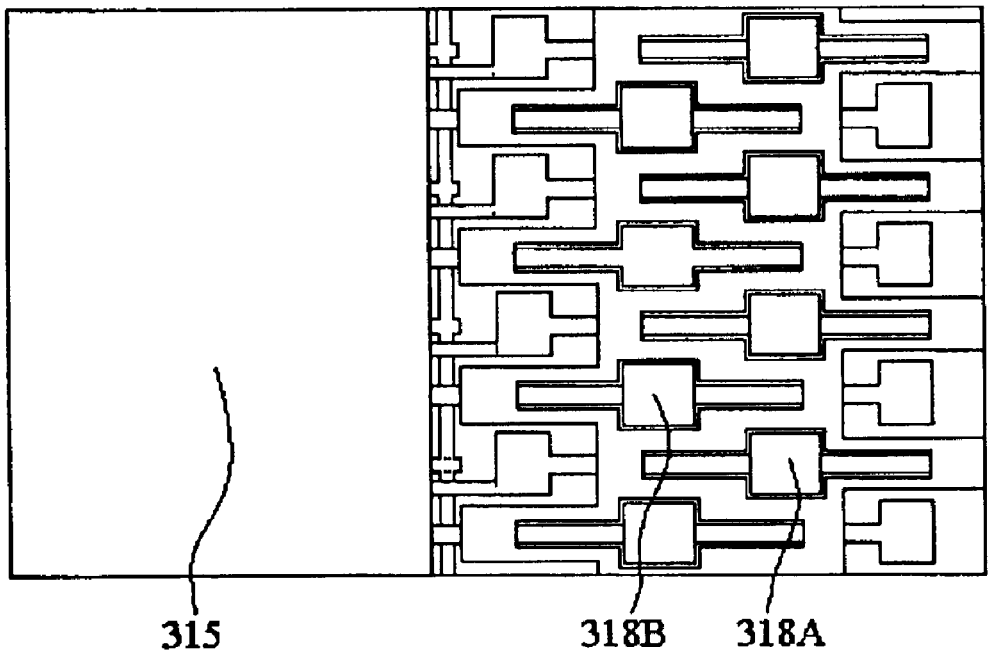
FIGS. 3(A) and 3(B) are top plane and cross-sectional views of an optical microswitch array in accordance with the second embodiment of the present invention.
Figure 3B:
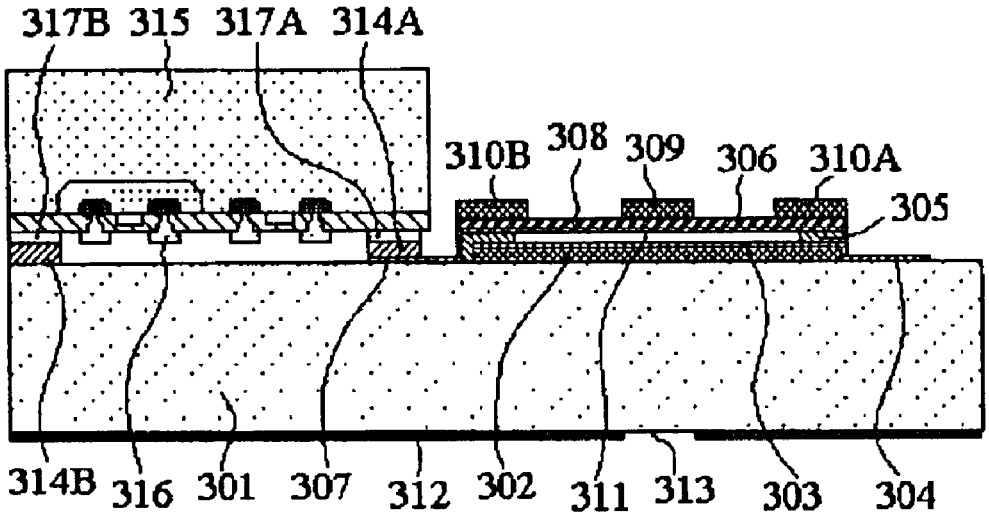

As shown in FIGS. 3(A) and 3(B), an optical microswitch array of a second embodiment, in accordance with the present invention, comprises a glass substrate 301, an optical switch array including a first row 318A and a second row 318B, and a driver circuit 316. Each of the optical microswitches comprises a variable air gap Fabry-Perot cavity disposed on the glass substrate 301. The variable air gap Fabry-Perot cavity consists of a bottom distributed Bragg reflector 302; a bottom electrode 303; a top electrode 306; a top supporting structure 308; a top distributed Bragg reflector 309; a middle air gap 311; and a separating layer 305.

All the distributed Bragg reflectors 302 and 309, electrodes 303 and 306, top supporting structure 308, middle air gap 311, and separating layer 305 are similar to a counterpart of the first embodiment in accordance with the present invention.

The bottom distributed Bragg reflector 302 can be directly deposited on the glass substrate 301. The distributed Bragg reflectors 302 and 309 comprise a stack of alternating layers of $SiO_2/TiO_2$ or $SiO_2/Ta_2O_5$ or $SiO_2/SiN_x$. The electrodes 303 and 306 may comprise non-absorbing $In_2O_3$:$SnO_2$ (5–10%) or the like. The top supporting structure 308 may consist of a central plane and at least two beams disposed on the edge of the central plane. The separating layer 305 may comprise $SiO_2$ or the like that can be deposited by PECVD. The middle air gap 311 is formed by removing a portion of the separating layer 305. So the separationg layer 305 can be named a sacrificial layer.

As can be shown in FIGS. 3(A) and 3(B), the driver circuit 316 is a CMOS driver circuit formed on a silicon substrate 315 that is mounted onto the glass substrate 301 or electrically connected to the glass substrate 301, not shown in FIGS. 3(A) and 3(B). The glass substrate 301 contains an electrical interconnection including connection pads 304 and 307. The connection pad 304 extends to the bottom electrode 302 and the connection pad 307 extends to the top electrode 306. The silicon substrate 315 contains an electrical interconnection including connection pads 317A and 317B. During the process of bonding the silicon substrate 315 onto the glass substrate 301 the connection pads on the silicon substrate 315 and the connection pads on the glass substrate 301 are aligned precisely so as to realize not only mechanical connection between the two substrates 301 and 315, but also electrical connection between the driver circuit 316 and the optical switches. It can be seen in FIGS. 3A and 3B that the optical microswitch array includes two optical microswitch rows 318A and 318B which are set apart by a certain distance, each row having a certain number of optical microswitches arranged at a certain pitch. If it is required, the optical microswitch array may include more optical microswitch rows.

The optical microswitch array further comprises a light-blocking layer 312 on the backside of the glass substrate 301. Since the glass substrate 301 is transparent in the visible light regime, a light-blocking layer should be coated on the backside so as to restrict the light path to the variable air gap Fabry-Perot cavities. There are a plurality of light windows including light window 313 created in the light-blocking layer 312 each of which is aligned with a corresponding cavity situated on the front side of the glass substrate 301. When a light illuminates the backside of the glass substrate 301, the light reaching the cavity must pass through the light window 313. The optical microswitch array also comprises an adapter (not shown in FIGS. 3A and 3B) for interfacing to a printer's CPU.

Figure 4A:
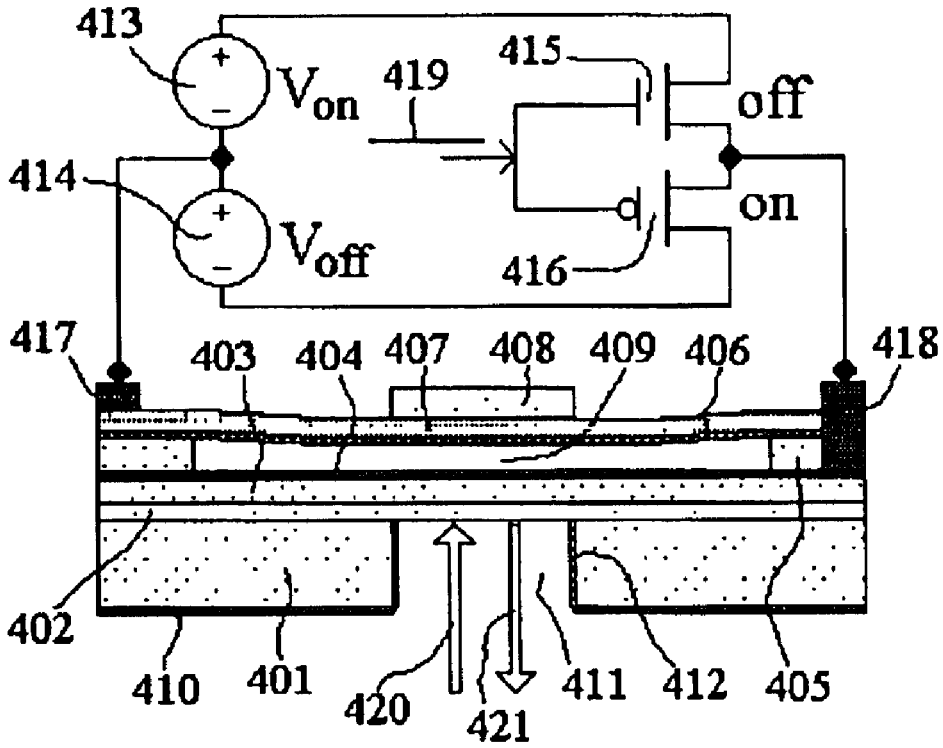
FIGS. 4(A) and 4(B) schematically illustrate the operation of an optical microswitch in accordance with the present invention.

Electrostatic actuation of an optical microswitch is schematically shown as in FIGS. 4 (A) and 4(B). A variable air gap Fabry-Perot cavity comprises a silicon substrate 401, a phosphorosilicate glass layer 402, a bottom distributed Bragg reflector 403, a bottom electrode 404, an air gap 409, a separating layer 405, a top electrode 406, a top supporting structure 407, a top distributed Bragg reflector 408, a light guiding hole 411, a backside reflecting layer 410, and a sidewall reflecting layer 412. A driver circuit is connected to the bottom electrode 404 and top electrode 406 through connection pads 418 and 417. The driver circuit comprises two separated voltage sources $V_{on}$, 413 and $V_{off}$ 414 and a CMOS switch consisting of a nCMOS transistor 415 and a pCMOS transistor 416. The voltage Von 413 is applied to the cavity through the CMOS transistor 415 and the voltage $V_{off}$ 414 is applied to the cavity through the CMOS transistor 416. The CMOS switch is controlled by an input digital signal that is applied to the gate of the CMOS switch. FIG.

Figure 4B:
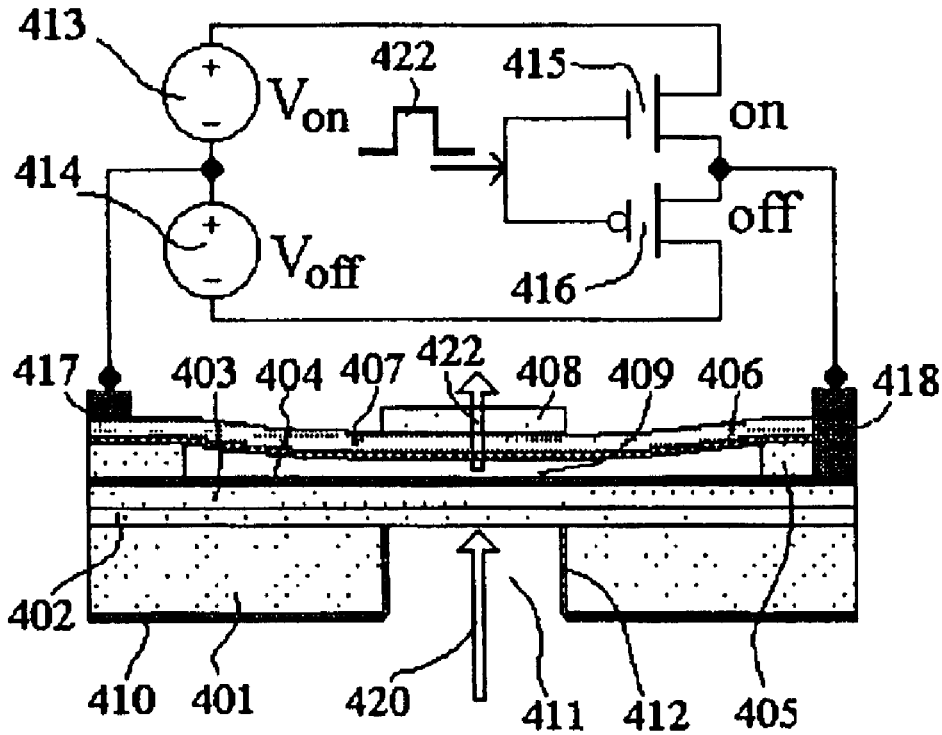

4(A) shows that the input digital signal is "0" 419, the CMOS transistor 415 is open and the CMOS transistor 416 is closed. The voltage $V_{off}$ 414 is applied to the cavity and the length of the air gap of the cavity is an odd multiple of $\lambda/4n$, where $\lambda$ is wavelength of a working light wave and the n is the refractive index of the air inside cavity. In this case the cavity is set at a reflection state or "off" state. An incident light bean 420 is reflected by the cavity and a reflected light beam 421 goes back from the cavity. FIG. 4(B) shows that the input digital signal is "1" 422, the CMOS transistor 416 is open and the CMOS transistor 415 is closed. The voltage $V_{on}$ 413 is applied to the cavity and the length of the air gap of the cavity is even multiple of $\lambda/4n$, where $\lambda$ is wavelength of a working light wave and the n is the refractive index of the air inside cavity. In this case the cavity is set at a transmission state or "on" state. An incident light beam 420 passes through the cavity and a transmitted light beam 422 goes forward from the cavity.

The voltages $V_{on}$ 413 and $V_{off}$ 414 can be varied according to the working light wavelength. The working light wavelength can be chosen in the stopband ($\lambda$) range of the distributed Bragg reflectors.

A method of fabricating an optical microswitch array according to a first embodiment of the present invention is described with reference to FIGS. 5–14. It should be noted that in fact the optical microswitch array consists of a plurality of optical microswitches. To simplify there is only one optical microswitch shown in FIGS. 5–14.

Figure 5:
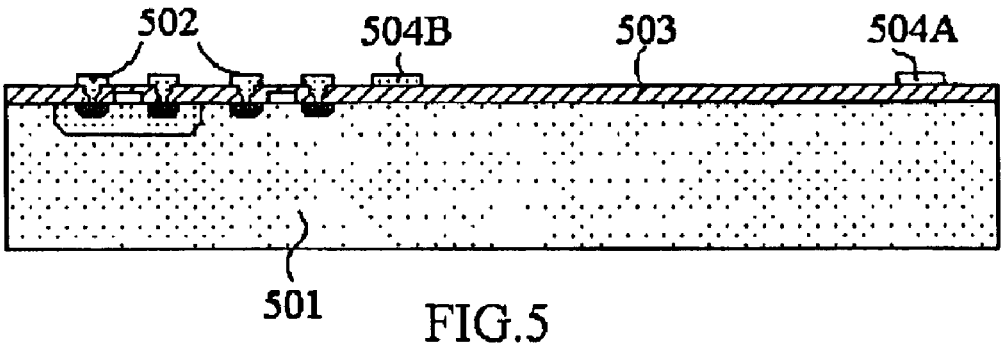
FIG. 5 is a cross-sectional view of an optical microswitch at a fabrication step showing a silicon substrate with a completed CMOS circuit disposed in a predetermined region in accordance with the first embodiment of the present invention.

In FIG. 5, a CMOS driver circuit 502 is disposed in a predetermined region of a silicon substrate 501 using standard CMOS circuit fabrication technologies. A proper interconnection is also made on the silicon substrate 501. The interconnection includes connection pads 504A and 504B on the edge of a predetermined region for disposing an optical microswitch array. The region to be situated by the optical microswitch array is coated with a phosphorosilicate glass layer that acts as a bottom-supporting layer 503. It should be noted that the phosphousilicate glass layer 503 is usually used as a passivation layer of the CMOS driver circuit 502, so it can be formed during the process for fabricating the CMOS driver circuit 502.

Figure 6:
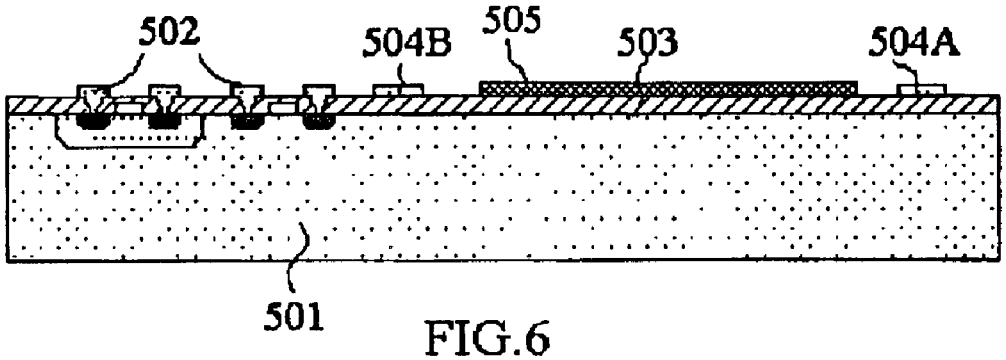
FIG. 6 is a cross-sectional view of an optical microswitch at a fabrication step showing the silicon substrate with a bottom distributed Bragg reflector disposed in another predetermined region in accordance with the first embodiment of the present invention.

In FIG. 6, a bottom distributed Bragg reflector 505 is disposed on the bottom-supporting layer 503. The distributed Bragg reflector 505 comprises a stack of alternating layers of $SiO_2/TiO_2$ As an alternative, the distributed Bragg reflector comprises a stack of $SiO_2/Ta_2O_5$. Still as an alternative, the distributed Bragg reflector comprises a stack of $SiO_2/SiN_x$. To create a distributed Bragg reflector from the alternating layers, a lift-off process is performed. In the lift-off process, a layer of about 4 micron-thick photoresist is put over the bottom-supporting layer 503 and patterned by a photolithography process so as to expose the phosphorosilicate glass in the pattern desired for the distributed Bragg reflector. The alternating layers are then deposited on the bottom supporting layer 503 by a sputtering process in which heating of the silicon substrate 501 is not required. The thickness of each layer of the alternating layers is adjusted to be $\lambda/4n$ by an interferometric thin film monitor. Interferometer is a powerful technique that can be used for endpoint detection of deposition or trench etching. The technique involves illuminating the surface of a wafer and measuring the reflected intensity. The pattern of the distributed Bragg reflector is effectively stenciled through the gaps in the photoresist, which is then removed lifting off the unwanted alternating layers with it.

As an alternative, the alternating layers of $SiO_2/TiO_2$ or $SiO_2/Ta_2O_5$ are deposited by an electron beam evaporation process in which the silicon substrate 501 is required to be heated up to 300° C. After deposition of the alternating layers a photolithography process is carried out to form a distributed Bragg reflector. Using the photoresist pattern as a protection mask the alternating layers are etched by a RIE process in which $SF_6$ is used as an etchant.

As an alternative, the alternating layers of $SiO_2/SiN_x$ are deposited by PECVD. The deposition conditions used for $SiN_x$ are RF power: 30 W, substrate temperature: 280° C., total gas pressure: 290 mtoor, gas flow rates: He 100 sccm, $NH_3$ 30 sccm, and $SiH_4$ 1 to 5 sccm. The refractive index of $SiN_x$ can be adjusted in a range 1.77 to 2.54 by varying the flow rate of $SiH_4$. A distributed Bragg reflector is then formed by photolithography. The etching method used can be a standard wet etching or dry etching process.

Figure 7:
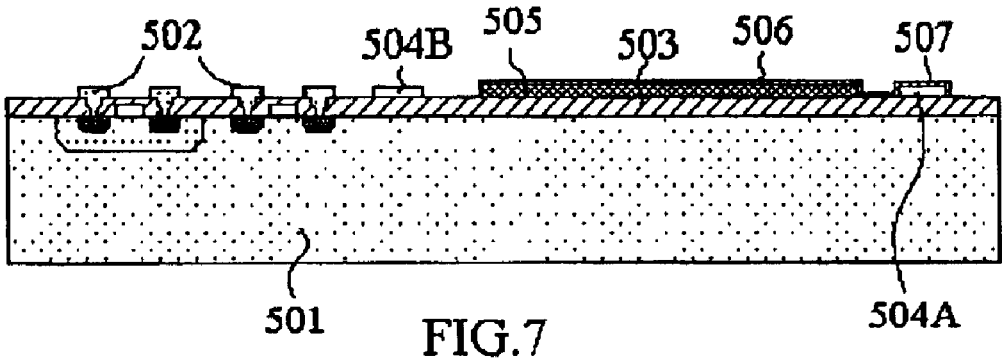
FIG. 7 is a cross-sectional view of an optical microswitch at a fabrication step showing the silicon substrate with a bottom electrode disposed on the bottom Bragg reflector in accordance with the first embodiment of the present invention.

In FIG. 7, a bottom electrode 506 is disposed on the bottom distributed Bragg reflector 505. The bottom electrode 506 comprises $In_2O_3$:$SnO_2$(5–10%) or the like deposited by a rf-magnetron sputtering system. The $In_2O_3$:$SnO_2$ target is a hot pressed $In_2O_3$ containing 5–10 wt % $SnO_2$. The deposition process is preceded in a mixed atmosphere of argon and oxygen gases where the gases are controlled by a mass flow meter. $Ar/O_2$ is controlled in the range from 0.2% to 15%. Base pressure of the sputtering system is $1.6\times10^{-6}$ torr, the process pressure is 3.2×10-3 torr and the sputtering power applied in the process is 136 W. The thickness of the layer is controlled to be 2 to $5\times\lambda/4n$. The electrode 506 with a thickness of 2 to $5\times\lambda/4n$ is formed by a lift-off process. As an alternative, a post-deposition photolithography process forms the electrode 505. Unwanted $In_2O_3$:$SnO_2$ layer is etched in HCl solution. The electrode 506 extends out of the distributed Bragg reflector 505 so as to form a cover 507 situated on the connection pad 504A.

Figure 8:
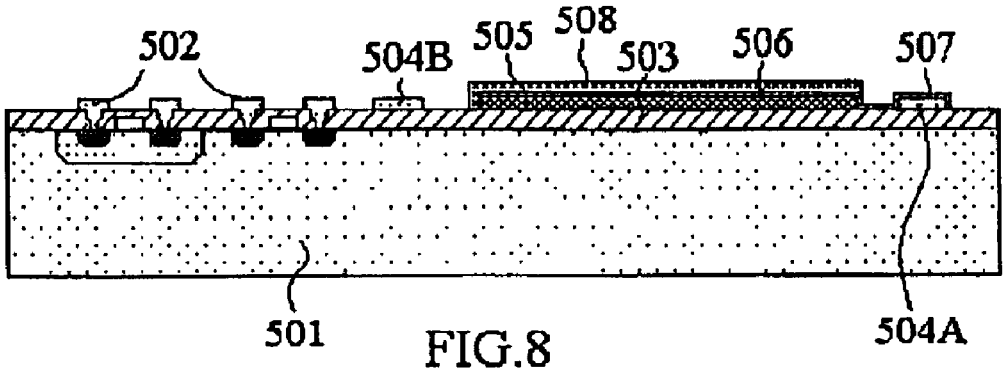
FIG. 8 is a cross-sectional view of an optical microswitch at a fabrication step showing the silicon substrate with a sacrificial layer disposed on the bottom electrode in accordance with the first embodiment of the present invention.

In FIG. 8, a separating layer 508 is disposed on the electrode 506. The separating layer comprises $SiO_2$ or the like deposited by PECVD. The thickness of the $SiO_2$ is controlled to be $(\text{even}+1/8)\times\lambda/4n$ covering the range of 500 nm to 1000 nm using a standard crystal thin film monitor.

Figure 9:
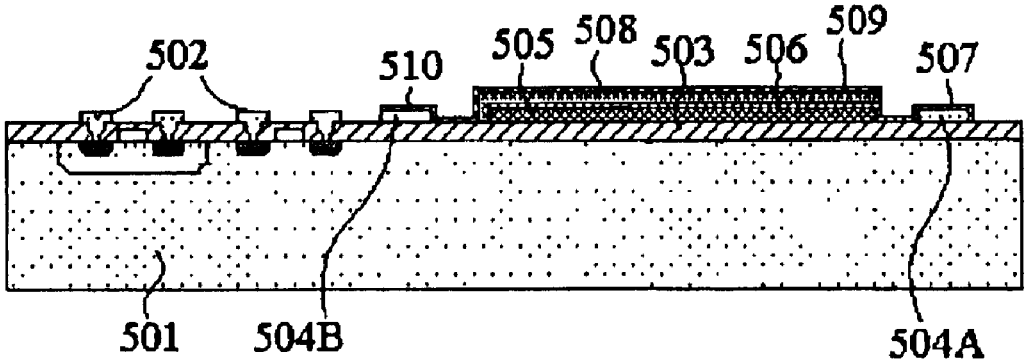
FIG. 9 is a cross-sectional view of an optical microswitch at a fabrication step showing the silicon substrate with a top electrode disposed on the sacrificial layer in accordance with the first embodiment of the present invention.

In FIG. 9, a top electrode 509 with a thickness of 2 to $5\times\lambda/4n$ is disposed on the separating layer 508. The process for forming the top electrode 509 is similar to the process for forming the bottom electrode 506. The top electrode 509 extends to a cover 510 that situates over the connection pad 504B.

Figure 10:
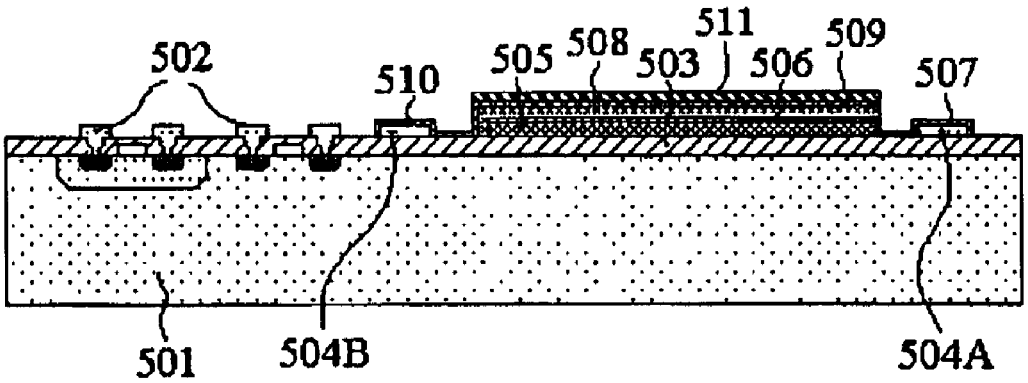
FIG. 10 is a cross-sectional view of an optical microswitch at a fabrication step showing the silicon substrate with a top supporting structure disposed on the top electrode in accordance with the first embodiment of the present invention.

In FIG. 10 a top supporting structure 511 is disposed on the top electrode 509. The top supporting structure comprises $Si_3N_4$ A standard PECVD process deposits the $Si_3N_4$ layer. The thickness of the $Si_3N_4$ layer is controlled to be an even multiple of $\lambda/4n$ covering a range of 200 to 400 nm. A dielectric layer with such a thickness has no effect for light interference of multiple dielectric layers but can provide enough mechanical strength for a supporting structure to be formed.

The top supporting structure 511 consists of a central plane of $10\times10\ \mu m^2$ to $100\times100\ \mu m^2$ and at least two side beams with 10 to 100 $\mu$m in length, 2 to 20 $\mu$m in width which are disposed at the two opposite sides of the central plane. Such a configuration of the top supporting structure 511 is created by photolithography.

As an alternative, the top supporting structure 511 comprises amorphous SiC with lower stress. The amorphous SiC layer is deposited by PECVD. Used deposition parameters can be temperature 400° C., pressure 2 torr, power 600 W, and Gas flow rate: 250 sccm of $SiH_4$ and 3000 sccm of $CH_4$.

As a further alternative, the top supporting structure 511 comprises polysilicon. A two-step process can be adapted to form a recrystallized amorphous silicon layer. As a first step, an amorphous silicon layer is deposited by PECVD. Deposition conditions used are RF power 30 W, substrate temperature 250° C., total gas pressure 170 torr, and gas flow rates: He 100 sccm and $SiH_4$ 1 sccm, respectively. As a second step, the formed amorphous silicon layer is annealed by laser scanning. A used laser is a XeCl laser with a beam size of 5 mm×5 mm and pulse width of 45 ns. The energy density is varied in a range of 240 to 330 mJ/cm$^2$. Then the top supporting structure 511 is formed following a standard photolithography process.

Figure 11:
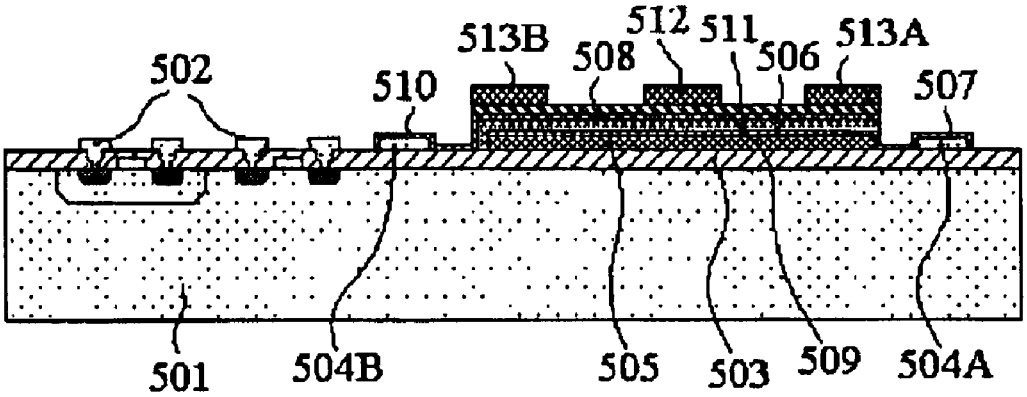
FIG. 11 is a cross-sectional view of an optical microswitch at a fabrication step showing the silicon substrate with a top distributed Bragg reflector disposed on the top supporting structure in accordance with the first embodiment of the present invention.

In FIG. 11, a top distributed Bragg reflector 512 is disposed on the top supporting structure 511. The process for forming the top distributed Bragg reflector 512 is similar to the process for forming the bottom distributed Bragg reflector 505.

As shown in FIG. 11, two anchor-enhanced ridges 513A and 513B are disposed on the top supporting structure 511. These anchor-enhanced ridges 513A and 513B are formed at the same step for forming the top distributed Bragg reflector 512 and will be used to provide an enhanced mechanical support to the side beams of the top supporting structure.

Figure 12:
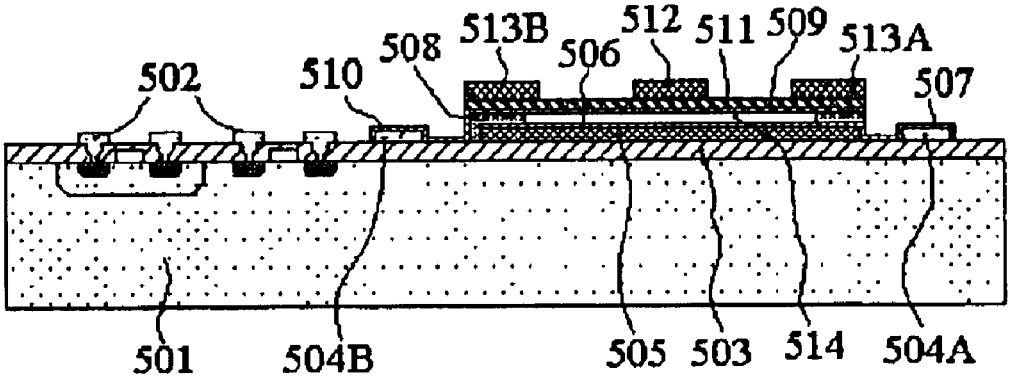
FIG. 12 is a cross-sectional view of an optical microswitch at a fabrication step showing the silicon substrate with a completed variable air gap Fabry-Perot thereon in accordance with the first embodiment of the present invention.

In FIG. 12, an air gap 514 is created between the bottom electrode 506 and top electrode 509. A portion of the separating layer 508, which is sandwiched in between the bottom electrode 506 and top electrode 509, can be selectively etched with a HF solution. As well known, HF solution does not attack the two electrodes 506 and 509 that comprise $In_2O_3$:$SnO_2$. During the etching process the bottom electrode 509 protects the top supporting structure 511, so the top supporting structure can remain unchanged. The two distributed Bragg reflectors 505 and 512 can resist etching of HF solution so they also remained unchanged. After etching the top supporting structure 511 and the top electrode 509 are suspended over the bottom electrode 506 and the top structure or the two beams of the top supporting structure 511 become flexible.

Figure 13:
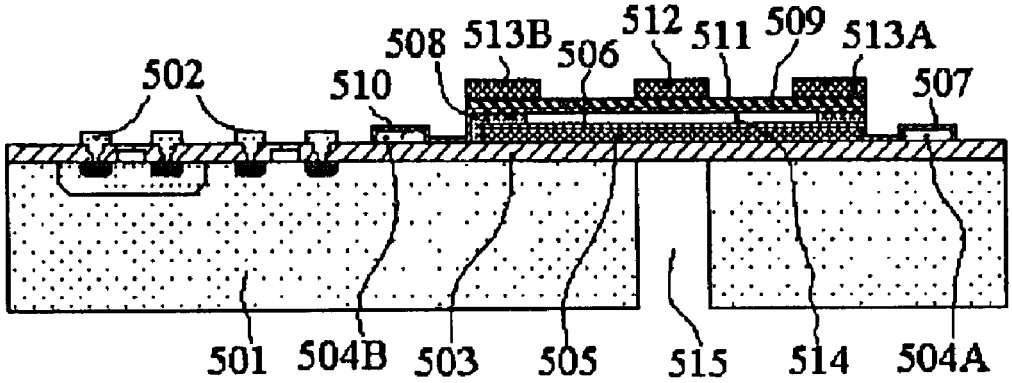
FIG. 13 is a cross-sectional view of an optical microswitch at a fabrication step showing the silicon substrate with a hole on the back side which vertically extends to the back side of the variable air gap Fabry-Perot cavity in accordance with the first embodiment of the present invention.

In FIG. 13, a vertical hole 515 aligned with the top distributed Bragg reflector 512 is created on the backside of the silicon substrate 501. The vertical hole 515 is etched into the silicon substrate 501 by reactive ion etching (RIE) based upon the Bosch ICP process. This etching process is featured with highly an-isotropic, fast etching, large selectivety to mask material, and complete geometry control. The etching is automatically stopped at the backside of the bottom-supporting layer 503 comprising phosphousilicate glass. It is preferable that before RIE etching the silicon substrate 501 is thinned to about 100 micron thick so as to save the etching time.

Figure 14:
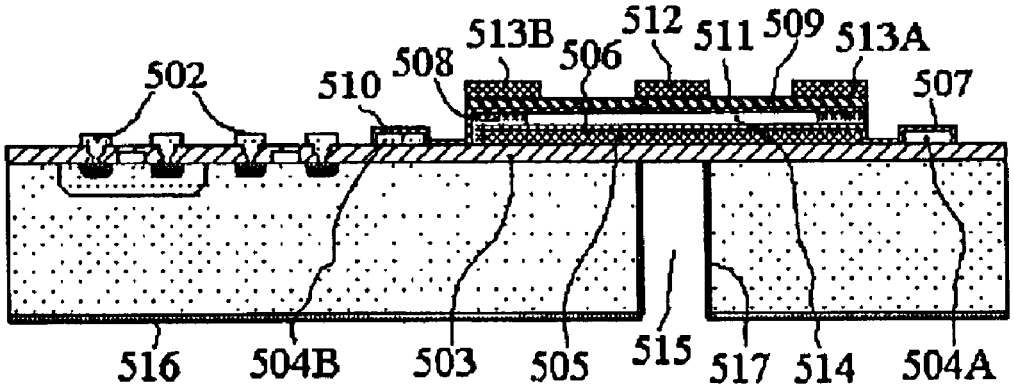
FIG. 14 is a cross-sectional view of an optical microswitch at a fabrication step showing the silicon substrate with a reflecting layer on the back side of the silicon substrate and on the side wall of the vertical hole in accordance with the first embodiment of the present invention.

In FIG. 14, a metal layer 516 and 517 are coated on the sidewall of the vertical hole 515 and the backside of the silicon substrate 501 respectively. To do this, a gold electroplating process is performed using a non cyanide-based gold plating solution. This mildly acidic, pH of 6 to 7, sodium gold sulfite bath showed good compatibility with photoresists. A current density of 3 A/ft$^2$ is used. The gold layer only covers the exposed silicon surface of the silicon substrate 501. On the backside of the bottom-supporting layer 503 there is no gold layer because the bottom-supporting layer is not conductive.

As an alternative, the optical microswitch array and the driver circuit can be formed in a separate silicon substrate. Then the driver circuit chip is bonded onto the silicon substrate that carries the optical microswitch array or electrically connected to the otpcal microswitch array by wire bonding.

A method of fabricating an optical microswitch array according to a second embodiment of the present invention is described with reference to FIGS. 15–17. Items not particularly mentioned in relation to this embodiment are similar to those of the first embodiment. It should be noted that in fact the optical microswitch array consists of a plurality of optical microswitches. To simplify, there is only one optical microswitch shown in FIGS. 15–17.

Figure 15:
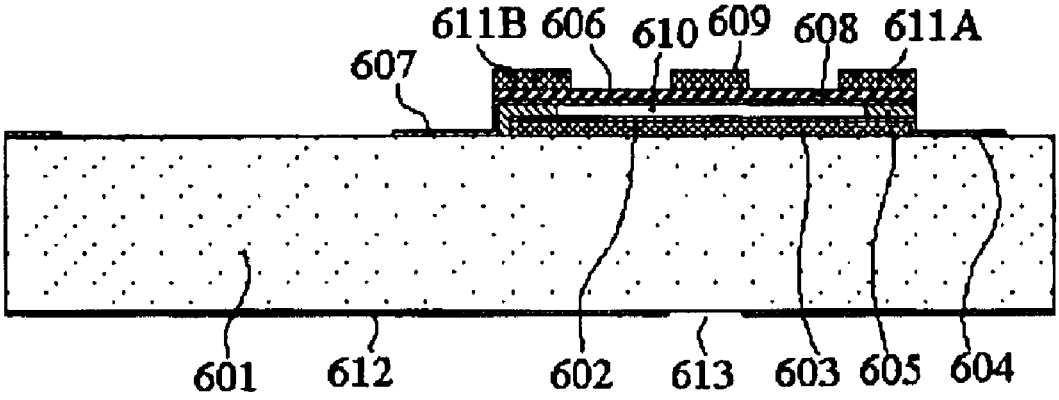
FIG. 15 a cross-sectional view of an optical microswitch at a fabrication step showing a glass substrate with a completed variable air gap Fabry-Perot cavity thereon in accordance with the second embodiment of the present invention.

As shown in FIG. 15, a variable air gap Fabry-Peron cavity comprised by an optical microswitch is placed on a glass substrate 601. The glass substrate 601 is a thin film transistor liquid crystal display (TFT-LCD) glass plate. Such a glass plate is lighter, thinner, larger and more durable. The variable air gap Fabry-Peron cavity comprises a bottom distributed Bragg reflector 602, a bottom electrode 603, a top electrode 606, a top flexible supporting structure 608, a top distributed Bragg reflector 609, a middle air gap 610, and at least two anchor enhanced ridges 611A and 611B. A separating layer 605 that is also used as a supporting layer for the top flexible structure 608 surrounds the middle air gap 610. The top flexible structure 608 is configured so as to have a central plane and at least two beams disposed at the two opposite sides of the central plane. Both the bottom electrode 603 and top electrode 606 are extended to a connection pad 604 and 607, respectively. The connection pads 604 and 607 will be connected to a driver circuit. On the backside of the glass substrate 601 there is a light reflecting layer 612 and a light window 613 that is aligned with the top distributed Bragg reflector 609

The distributed Bragg reflectors 602 and 609 comprise a stack of alternating layers of $SiO_2/TiO_2$ or $SiO_2/Ta_2O_5$ or $SiO_2/SiN_x$. The alternating layers of $SiO_2/TiO_2$ and $SiO_2/Ta_2O_5$ are deposited by sputtering. The alternating layers of $SiO_2/SiN_x$ are deposited by PECVD. The thickness of each layer is controlled to be $\lambda_0/4n$ using an interferometric thin film monitor.

The electrodes 603 and 606 comprise $In_2O_3$:$SnO_2$ or the like deposited by sputtering. The thickness of the $In_2O_3$:$SnO_2$ layer is controlled to be be 2 to 5×λ/4n. The separating layer 605 comprises $SiO_2$ or the like deposited by PECVD and having a thickness of (even+⅛)×λ/4n being the range of 500 to 1000 nm. The top supporting structure 608 comprises $Si_3N_4$ deposited by a standard PECVD process.

As an alternative the top supporting structure 608 comprises SiC deposited by a PECVD process similar to the process for the first embodiment in accordance with the present invention. Still as an alternative the top supporting structure 608 comprises polysilicon that is formed by recrystallization of amorphous silicon deposited by PECVD.

The thickness of the top supporting structure 608 is controlled to be even nultiple of λ/4n being a range of 200 to 400 nm. The top supporting structure 608 is configurated to have a central plane of 10×10 to 100×100 $\mu$m$^2$ and at least two supporting beams with 10 to 100 $\mu$m in length, 2 to 20 $\mu$m in width which are disposed at the two opposite sides of the central plane.

The top supporting structure 608 is released by selective etching of a portion of the underlying separating layer 605 which is sandwiched in between the two electrodes 603 and 606. After releasing the top supporting structure 608 becomes flexible and the length of the formed air gap 610 can be changed by applying a voltage across the two electrodes 603 and 606.

Figure 16:
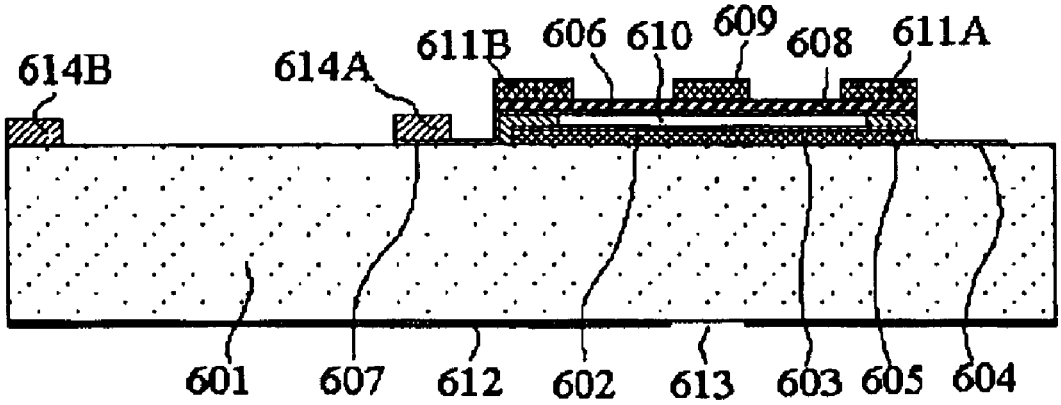
FIG. 16 a cross-sectional view of an optical microswitch at a fabrication step showing the glass substrate with a mechanical bonding bump and an electrical connection bonding bump both placed on a corresponding connection pad of the variable air gap Fabry-Perot cavity in accordance with the second embodiment of the present invention.

In FIG. 16, an electrical connection bump 614A and a mechanical connection bump 614B are placed on the glass substrate 601 and a light blocking layer 612 with a light window 613 is disposed on the backside of the glass substrate 601. The bumps 614A and 614B comprise AuSn (Au5%) that melts at 217° C. In order to form the bumps 614A and 614B a thicker photoresist pattern is formed by photolithography. Then an AuSn layer is deposited by stacking alternating electron beam evaporated Au and Sn layers. After removing the photoresist pattern the formed bumps are treated by reflowing the AuSn layer. The alloy composition of the AuSn layer can be precisely controlled using a predetermined thickness of each layer. The diameter of the bumps 614A and 614B is controlled to be 50 $\mu$m and the height is controlled to be 10 $\mu$m.

As an alternative, the bumps 614A and 614B comprise pure Indium. After forming a thicker photoresist pattern an Indium layer is deposited by electron beam evaporation. Since the melting temperature of Indium is very low the temperature of the glass substrate 601 should keep at a temperature lower than 50° C. during the deposition process.

The light blocking layer 612 comprises a gold layer deposited by an electron beam evaporation process. A photolithographic process forms the light window 613.

Figure 17:
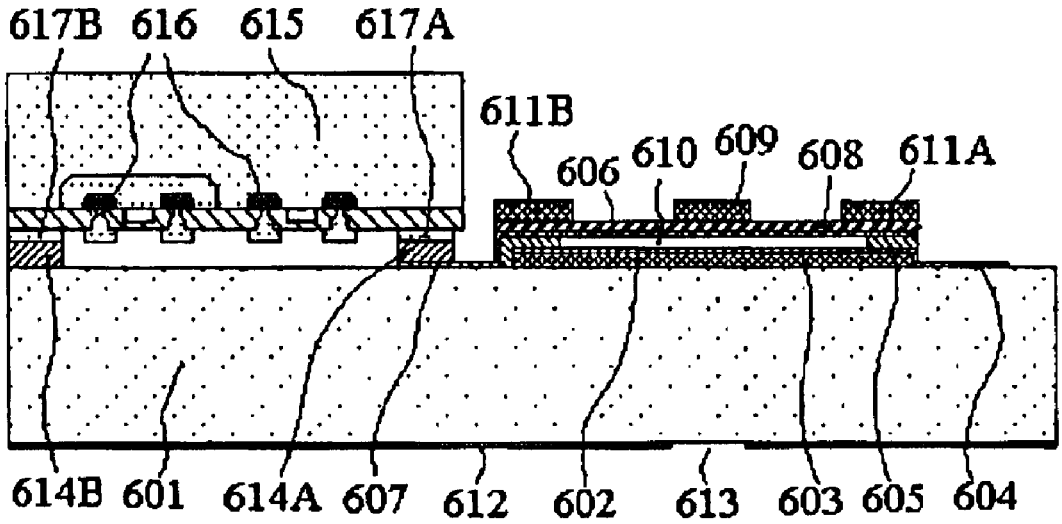
FIG. 17 a cross-sectional view of an optical microswitch at a fabrication step showing the glass substrate with a silicon chip containing a CMOS driver circuit mounted thereon in accordance with the second embodiment of the present invention.

In FIG. 17, a silicon chip 615 is placed on the glass substrate 601 by a flip-chip assembly process. As can be seen in FIG. 17, two connection pads 617A and 617B, and a CMOS driver circuit 616 are formed on the silicon chip 615. The driver circuit 616 is connected to the variable air gap Fabry-Perot cavity through the connection pad 617A, electrical connection bump 614A and connection pad 607 that are bonded together. The connection pad 617B is bonded onto the mechanical connection bump 614B so as to enhance the mechanical connection between the silicon chip 615 and the glass substrate 601. It should be noted that a connection pad disposed on the silicon chip 615 and an electrical connection bump disposed on the glass substrate 601 and connecting to the electrical connection 604 are also bonded together but not shown in FIG. 17.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. An optical microswitch array, comprising:

a silicon substrate, a plurality of optical microswitches each comprising:

a bottom supporting layer disposed on the silicon substrate;

a bottom distributed Bragg reflector comprising a stack of alternating layers of non-absorbing high refractive index dielectric material and low refractive index dielectric material and disposed on the bottom supporting layer;

a bottom electrode disposed on the bottom distributed Bragg reflector;

a middle air gap disposed on the bottom electrode;

a separating layer surrounding the middle air gap;

a top electrode disposed above the middle air gap and on the separating layer;

a top supporting structure having a central plane and at least two side inflexible beams and disposed on the top electrode; and a top distributed Bragg reflector comprising a stack of alternating layers of high refractive index dielectric material and low refractive index dielectric material and disposed on the top supporting structure;

a driver circuit electrically connected to the variable air Fabry-Perot cavities and selectively turning the optical microswitches "on" or "off";

a plurality of light guiding holes disposed in the silicon substrate and each perpendicularly extending to a corresponding variable air gap Fabry-Perot cavity, and an electrical connection means for interfacing to a printer's CPU.

2. The optical microswitch array of claim 1, wherein the air gap of the variable air gap Fabry-Perot cavities can be set to be equal to an odd or even multiple of a quarter wavelength of a working optical wave by applying a voltage.

3. The optical microswitch array of claim 1, wherein the bottom supporting layer comprises $SiO_2$ or the like.

4. The optical microswitch array of claim 1, wherein the separating layer comprises $SiO_2$ or the like.

5. The optical microswitch array of claim 1, wherein the distributed Bragg reflectors comprise a stack of alternating layers of $SiO_2$ and $TiO_2$ having the thickness equal to $\lambda_0/4n$, where $\lambda_0$ is the working optical wavelength and n is the refractive index.

6. The optical microswitch array of claim 1, wherein the distributed Bragg reflectors comprise a stack of alternating layers of $SiO_2$ and $Ta_2O_5$ with the thickness of each layer being equal to $\lambda_0/4n$, where $\lambda_0$ is the working optical wavelength and n is the refractive index.

7. The optical microswitch array of claim 1, wherein the distributed Bragg reflectors comprise a stack of alternating layers of $SiO_2$ and $SiN_x$ with the thickness of each layer being equal to $\lambda_0/4n$, where $\lambda_0$ is the working optical wavelength and n is the refractive index.

8. The optical microswitch array of claim 1, wherein the electrodes comprise $In_2O_3$:$SnO_2$(5–10%) or the like.

9. The optical microswitch array of claim 1, wherein the top supporting structure comprises $Si_3N_4$.

10. The optical microswitch array of claim 1, wherein the top supporting structure comprises amorphous SiC.

11. The optical microswitch array of claim 1, wherein the top supporting structure comprises polysilicon recrystallized from amorphous silicon.

12. The optical microswitch array of claim 1, wherein the driver circuit is integrated with the optical microswitch array by monolithic integration.

13. The optical microswitch array of claim 1, wherein the driver circuit is integrated with the optical microswitch array by hybrid packaging.

14. The optical microswitch array of claim 1, wherein the light guiding holes have a metal reflecting layer coated on the sidewalls.

15. A method of fabricating an optical microswitch array comprising the steps:

forming a CMOS driver circuit in a predetermined region of a silicon substrate using standard CMOS circuit fabrication technologies, depositing a bottom supporting layer in another predetermined region of the silicon substrate;

fabricating a plurality of bottom distributed Bragg reflectors on the supporting layer;

forming a plurality of bottom electrodes each disposed on and aligned with an underlying bottom Bragg reflector;

depositing a separating layer covering the bottom electrodes;

forming a plurality of top electrodes each disposed on the separating layer and aligned with an underlying bottom electrode;

defining a plurality of top supporting structures each disposed on and aligned with an underlying top electrode;

fabricating a plurality of top distributed Bragg reflectors each disposed on and aligned with an underlying top supporting structure;

forming a plurality of vertical holes disposed in the backside of the silicon substrate and each aligned with a corresponding Fabry-Perot cavity on the front side;

depositing a metal layer on the sidewalls of the vertical holes by electroplating; and releasing the top supporting structures and top electrodes by selectively etching the underlying separating layer so as to form a plurality of variable air gap Fabry-Perot cavities each defined by two non-absorbing distributed Bragg Reflectors and one of distributed Bragg reflector supporting by the released top supporting structure.

16. The method of fabricating an optical microswitch array of claim 15, wherein the bottom supporting layer comprises $SiO_2$ or the like.

17. The method of fabricating an optical microswitch array of claim 15, wherein the separating layer comprises $SiO_2$ or the like.

18. The method of fabricating an optical microswitch array of claim 15, wherein the electrodes comprise $In_2O_3$:$SnO_2$(5–10%) or the like.

19. The method of fabricating an optical microswitch array of claim 15, wherein the distributed Bragg reflectors comprise a stack of alternating layers of $SiO_2$ and $TiO_2$ having the thickness equal to $\lambda_0/4n$, where $\lambda_0$ is the working optical wavelength and n is the refractive index.

20. The method of fabricating an optical microswitch array of claim 15, wherein the distributed Bragg reflectors comprise a stack of alternating layers of $SiO_2$ and $Ta_2O_5$ having the thickness equal to $\lambda_0/4n$, where $\lambda_0$ is the working optical wavelength and n is the refractive index.

21. The method of fabricating an optical microswitch array of claim 15, wherein the distributed Bragg reflectors comprise a stack of alternating layers of $SiO_2$ and $SiN_x$ having the thickness equal to $\lambda_0/4n$, where $\lambda_0$ is the working optical wavelength and n is the refractive index.

22. The method of fabricating an optical microswitch array of claim 15, wherein the top supporting structure comprises $Si_3N_4$.

23. The method of fabricating an optical microswitch array of claim 15, wherein the top supporting structure comprises amorphous SiC.

24. The method of fabricating an optical microswitch array of claim 15, wherein the top supporting structure comprises polysilicon recrystallized from amorphous silicon.

25. The method of fabricating an optical microswitch array of claim 15, wherein the released top supporting structure comprises a central plane and at least two side flexible beams disposed on the edge of the central plane.

* * * * *